United States Patent [19]

Schmidt

[11] Patent Number: 4,697,436

[45] Date of Patent: Oct. 6, 1987

[54] COSTUME JEWELRY CIRCLET

[76] Inventor: Kenneth J. Schmidt, 24001 Country Squire Blvd., Apt. 204, Mt. Clemens, Mich. 48043

[21] Appl. No.: 817,896

[22] Filed: Jan. 13, 1986

[51] Int. Cl.[4] ..... A44C 5/00

[52] U.S. Cl. ..... 63/3; 63/DIG. 3

[58] Field of Search ..... 63/21, 22, 11, 3; D11/4, 6, 3; 2/338, 301

[56] References Cited

U.S. PATENT DOCUMENTS

| | | | |
|---|---|---|---|
| 253,242 | 2/1882 | Vester | 63/11 |
| 1,978,168 | 10/1934 | Reid | 63/11 X |
| 2,087,620 | 7/1937 | Lipton | 2/338 X |
| 2,885,684 | 5/1959 | Dye | 2/338 X |
| 4,087,989 | 5/1978 | Taran | 63/11 |
| 4,362,031 | 12/1982 | Obermuller | D11/3 |

FOREIGN PATENT DOCUMENTS

| | | | |
|---|---|---|---|
| 1000098 | 10/1951 | France | 63/3 |

*Primary Examiner*—Richard J. Johnson

*Attorney, Agent, or Firm*—Cullen, Sloman, Cantor, Grauer, Scott and Rutherford

[57] ABSTRACT

A costume jewelry circlet, such as a bracelet, necklace or belt, is formed of an inner, string-like core having its opposite ends connected together, upon which is positioned a tubular sleeve which extends around and covers substantially the first length of the core. The sleeve is interchangeable with other sleeves which are formed either with different surface textures or colors or cross-sectional shapes. Thus, the wearer of the costume jewelry may substitute one sleeve for another, as desired, within the discretion of the wearer, to produce different visual effects due to the varying textures, colors or shapes of the interchangeable sleeves.

10 Claims, 6 Drawing Figures

COSTUME JEWELRY CIRCLET

BACKGROUND OF INVENTION

A common type of costume jewelry circlet, that is, a bracelet or necklace, is formed of a continuous cord or string over which is positioned a tubular sleeve, which may be continuous or discontinuous, and which forms the decorative surface of the circlet. In the past, the sleeves have been made of a variety of materials, including cloth or plastic materials of various colors and surface textures.

Conventionally, the wearer of the jewelry purchases the particular color or texture desired for a particular appearance purpose. Thus, the wearer may have a number of different necklaces or bracelets to wear at different times in accordance with the paticular clothing worn at that time.

Although the costs of costume jewelry necklaces and bracelets may be relatively low, as compared with precious metal circlets, because of a need for a number of different circlets, the overall cost may become relatively high. Consequently, the invention herein relates to a simple circlet construction, that is, for a bracelet or necklace, wherein the exterior surface appearance, i.e. the color, texture or shape, may be optionally changed by the wearer so that a single circlet may be used with a variety of outfits.

SUMMARY OF INVENTION

The invention herein contemplates a circlet, such as a bracelet, necklace or belt, formed with an interior string-like core, over which is mounted a tube of predetermined surface texture, color or shape. The opposite ends of the core are fastened together by a suitable fastening means. When desired, the wearer may remove the sleeve by simply disengaging the ends of the core and pulling the sleeve off the core, and replacing it with a different sleeve which may have a different surface texture, shape or color. Thus a single circlet may be given a different appearance, with little effort or time, and its overall cost may be materially reduced as compared to having a number of circlets in the wearer's wardrobe.

The invention contemplates forming exterior tubes of cloth, cloth-like plastic, or plastic and the like of different cross-sectional shapes, textures or colors. Thus, the wearer can take a single circlet, with one or more extra sleeves and interchange the sleeves as desired. This is particularly useful for travel, or even daily carrying, where a number of sleeves can be carried in a bag for use when desired.

One significant object of this invention is to make available inexpensive, changeable appearance bracelets, necklaces and belts, and wherein the change from one appearance to another may be effected with minimal effort and time These and other objects and advantages of this invention will become apparent upon reading the following description, of which the attached drawings form a part.

DETAILED DESCRIPTION

Figure 1:
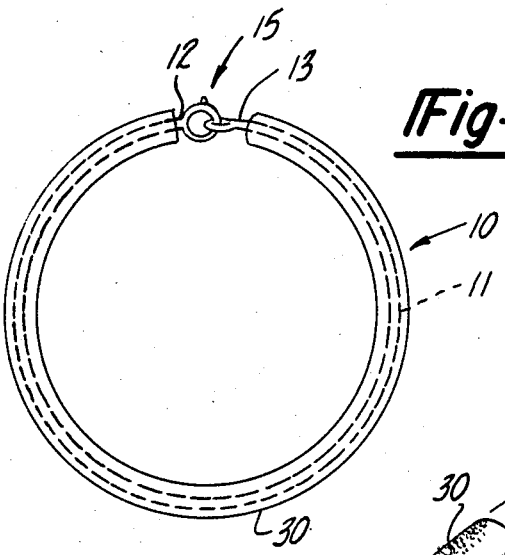
FIG. 1 is a view of a costume jewelry circlet, which may be a bracelet, necklace or belt, depending upon its size.

FIG. 1 illustrates a costume jewelry circlet 10, which may be a bracelet, necklace or belt or the like, depending upon its size. The circlet has an interior core 11, which is a cord or string-like strip of material that may made of a natural fiber, such as cotton, or synthetic plastic fiber string or of a relatively stiff, but somewhat flexible, metal wire. The core 11 has its opposite ends 12 and 13 connected together by a suitable fastening means.

Figure 2:
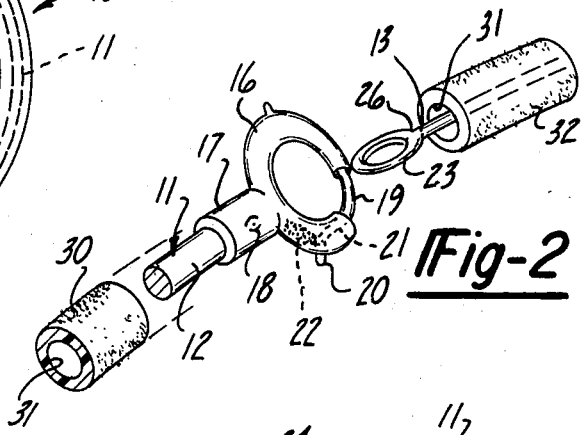
FIG. 2 is a perspective, fragmentary view of a means for interconnecting the opposite ends of the core.

FIG. 2 illustrates a conventional fastener 15 securing costume jewelry ends together. Such fastener 15 comprises a ring 16 having a socket 17 slipped over end of the core and fastened thereto by an indentation 18. The ring has an endwise slidable wire-like keeper 19 which fits into the open ends of the hollow ring and which may be retracted by means of grasping the protruding end of a small lug 20 which extends outwardly of a slot 21 formed in the ring. A suitable spring 22 may be located within the ring to hold the keeper in fastening position and resist retraction of it.

The opposite end of the cord may be provided with a small loop 23 which is engaged with the ring. The loop may be formed integral with the end of the cores or may be formed of a separate metal ring having a socket 26 fastened on the end 13 of the core.

As shown in FIGS. 1 and 2, a sleeve 30 is slid over the core and extends substantially the full length of the core. The sleeve has an interior, central or axial hole 31 which receives the core. FIG. 2 illustrates a sleeve 31 which has a textured surface 32 and may be of any preselected color.

Figure 3:
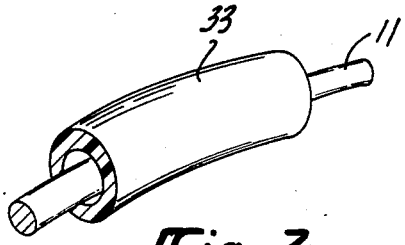
FIG. 3 is a fragmentary, cross-sectional, perspective view showing a circular sleeve slipped over a central core.

The sleeve may have a different surface texture, as for example, it may be smooth, or it may be roughly woven or have a pile fiber texture or the like. Thus, FIG. 3 illustrates a modification wherein the surface of the sleeve 33 is illustrated as being smooth. Here, the sleeve may be made of a plastic tubing of a different color and, as mentioned, of a different texture than the sleeve 30.

Figure 4:
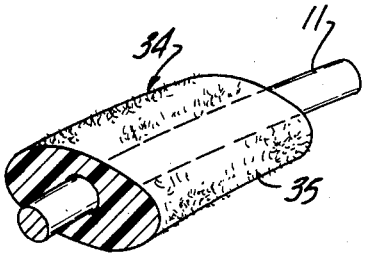
FIG. 4 is a perspective, fragmentary view showing an elliptical cross-section, surface-textured sleeve upon the core.

The cross-sectional shape of a sleeve may be changed for different decorative purposes. Thus, FIG. 4 shows a modification wherein an elliptical cross-section sleeve 34 is shown. This sleeve has a textured surface 35, such as for example a pile fiber surface, and may be made of a suitable plastic or fabric material to give that effect.

Figure 5:
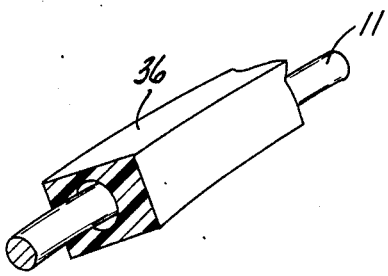
FIG. 5 is a cross-sectional, fragmentary view, showing a rectangular cross-sectional sleeve mounted upon the core.
Figure 6:
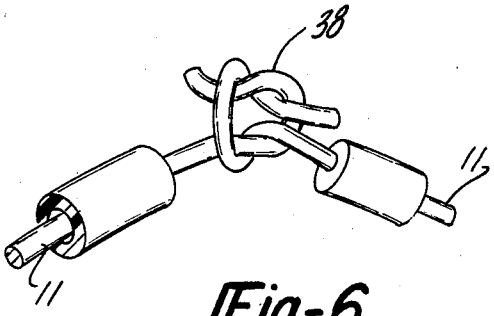
FIG. 6 illustrates the opposite ends of the core tied together in a knot for effecting the connection between them.

As shown in FIG. 5, the cross-sectional shape of the sleeve may be formed as a rectangle, wherein the sleeve 36 may be made of a continuous plastic extrusion of a predetermined color and surface texture. Likewise, the cross-sectional shape may be further varied and the surface texture and color of the sleeve may be additionally varied to give the wearer an assortment of different sleeves.

The means for fastening the ends of the core together can be something as simple as a knot 38 which interconnects both ends. Other types of conventional fasteners may be used. In each instance, the means for fastening the ends of the core must be readily disengagable so that the wearer of the costume jewelry may easily disconnect the ends of a core, slide the sleeve off the core, thread the core through another sleeve, and then refasten the adjacent core ends to provide the different appearance circlet.

It is contemplated that the wearer of the circlet of this invention will typically have an assortment of different sleeves for interchanging them as desired for particular wardrobe appearance purposes. The wearer may even carry a number of sleeves and interchange them as desired in the course of a day or other period of time. This permits quick changes from informal to formal appearing necklaces, bracelets and belts, depending upon the time of day and the wardrobe appearances desired.

Having fully described an operative embodiment of this invention, I now claim:

1. A costume jewelry circlet comprising:

a core formed of a length of non-extensible material having opposite ends;

a first removable elongated, semi rigid, thin wall, tublar sleeve having a first predetermined physical characteristic and having a continuous axial opening through which said core is inserted so that the first sleeve encircles and substantially completely covers the core along the length of the core;

a second removable elongated, semi rigid, thin wall, tubular sleeve having a second predetermined physical characteristic and having a continuous axial opening capable of insertably receiving the core therein so that the second sleeve encircles and substantially completely covers the core along the length of the core;

fastening means for disengageably connecting the opposite ends of said core to form a loosely fitting circlet having a first appearance associated with the physical characteristic of the first sleeve, said fastening means being adapted to permit removal of the core from the first sleeve, whereby the core may be inserted into the second sleeve to selectively give said circlet a second appearance associated with the physical characteristic of the second sleeve.

2. A costume jewelry circlet as defined in claim 1, wherein the physical characteristic of the second sleeve is defined by the second sleeve being formed of a different material having a different surface texture from the first sleeve.

3. A costume jewelry circlet as defined in claim 1, wherein the physical characteristics of the sleeves differ from one another only in color.

4. A costume jewelry circlet as defined in claim 1, wherein said core is formed of a metal wire material that is relatively stiff, but somewhat flexible.

5. A costume jewelry circlet as defined in claim 1, wherein said sleeves have different cross-sectional shapes.

6. A costume jewelry circlet as defined in claim 5, wherein esch of said sleeves has a substantially uniform cros-section, with the first sleeve being roughly circular in cross-section and the second sleeve being non-circular in cross-section.

7. A costume jewelry circlet as defined in claim 6, wherein the non-circular cross-section is roughly elliptical in shape.

8. A costume jewelry circlet as defined in claim 2, further including additional sleeves which differ in physical characteristic in color or surface texture from the first sleeve and the second sleeve, wherein the wearer of the jewelry may discretionarily interchange the sleeves as desired to produce different visual effects.

9. A costume jewelry circlet as defined in claim 1, wherein said core is formed of a non-metallic, string-like material, such as a plastic material, which is flexible, but somewhat stiff.

10. A costume jewelry circlet kit, comprising in combination:

a core formed of a length of non-extensible material having opposite ends;

a first removable elongated, semi rigid, thin wall, tubular sleeves having a first predetermined physical characteristic and having a continuous axial opening through which said core is inserted so that the first sleeve encircles and substantially completely covers the core along the length of the core;

a second removable elongated, semi rigid, thin wall, tubular sleeve having a second predetermined physical characteristic and having a continuous axial opening capable of insertably receiving the core therein so that the second sleeve encircles and substantially completely covers the core along the length of the core;

fastening means for disengagably connecting the opposite ends of said core to form a loosely circlet having a first appearance associated with the physical characteristic of the first sleeve, said fastening means being adapted to permit removal of the core from the first sleeve, whereby the core may be inserted into the second sleeve to selectively give said circlet a second appearance associated with the physical characteristic of the second sleeve.

* * * * *